United States Patent [19]

Möller et al.

[11] 4,002,427

[45] Jan. 11, 1977

[54] PROCESS FOR THE MANUFACTURE OF DYED MULTICOMPONENT FILAMENTS

[75] Inventors: Hilmar Möller; Joachim Wiegand, both of Hofheim, Taunus, Germany

[73] Assignee: Hoechst Aktiengesellschaft, Frankfurt am Main, Germany

[22] Filed: June 24, 1975

[21] Appl. No.: 589,864

[30] Foreign Application Priority Data

June 26, 1974 Germany ..... 2430626

[52] U.S. Cl. ..... 8/155.1; 8/155.2; 264/78; 264/171

[51] Int. Cl.[2] ..... D06B 5/16

[58] Field of Search ..... 264/171, 78; 8/155.1, 8/155.2

[56] References Cited

FOREIGN PATENTS OR APPLICATIONS

| | | | |
|---|---|---|---|
| 45-37570 | 11/1970 | Japan | 264/103 |
| 46-22171 | 6/1971 | Japan | 264/171 |
| 47-25821 | 7/1972 | Japan | 264/171 |

*Primary Examiner*—Jay H. Woo

*Attorney, Agent, or Firm*—Curtis, Morris & Safford

[57] ABSTRACT

A method of making crimped, dyed multicomponent filaments of at least 2 polyester components including spinning the filaments together in a side-by-side relationship or in an eccentric sheath-core relationship, stretching the spun filaments and developing the crimp. The crimped filaments are wound on a bobbin with a Shore hardness of from 15° to 70°, then dyed on the bobbin. The crimped dyed multicomponent filaments can be processed further to yield textile fabrics directly without an intermediate rewinding process.

6 Claims, No Drawings

PROCESS FOR THE MANUFACTURE OF DYED MULTICOMPONENT FILAMENTS

The invention is related to a process for the manufacture of dyed crimped multicomponent filaments of at least two polyester components by combining the spinning of polyester in side-by-side position or in eccentric sheath-core position, subsequent stretching, development of the crimp, spooling and dyeing.

The proposition has been made that false-twist textured yarn may be dyed on the bobbin (German "Offlenlegungsschrift" 23 02 872); however, this proposed process requires a respooling step after application of the false twist and prior to processing the yarn on a knitting loom. A further disadvantage of dyeing false-twist textured yarn on the bobbin is the loss of crimp.

Object of the present invention is to overcome these disadvantages.

This object has been achieved, surprisingly, in such a way that after development of the crimp the filament is wound on a tube having orifices with from 15° to 70° of Shore-hardness, preferably from 30° to 50° of Shore hardness, then dyed on the bobbin and processed further to yield textile fabrics without a further intermdiate re-winding step.

There are preferably used as one of the polyester components the polyetramethylene terephthalate and as the other polyester component a polyethylene terephthalate modified by means of triethoxy silane ethyl-phosphonic acid diethyl ester. Another preferred embodiment provides for a bicomponent filament composed of polyethylene terephthalate and of polyethylene terephthalate modified by means of triethoxy silane ethyl-phosphonic acid diethyl ester to be dyed at 100° C. Preference is also given to the use of a bicomponent filament, one component of which consists in polyethylene terephthalate and the other component of which is a polyethylene terephthalate which is modified either by means of trimellitic acid or of pentaerythrite.

According to the process of the present invention the crimpable filament is spun as per the known multicomponent-spinning method either in side-by-side or in eccentric sheathcore position and subsequently stretched in known manner.

The latent crimping of the stretched filament is then initiated by means of a heat treatment, e.g. by means of a device such as it has been described by British Patent 1 198 035. The crimped filament has to be wound on a bobbin equipped with orifices so that the dyeing liquor may pass through.

The crimped yarn wound on this bobbin is subsequently subject to a usual dyeing process. The yarn may be wound not too hard, in order not to prevent the dyeing liquor from penetrating through the bobbin. The suitable Shore hardness varies from 15° to 70°; especially favorable results are obtained with a Shore hardness from 30' to 50°, particularly well suitable is a Shore hardness of 40°.

By Shore hardness is to be understood the Shore hardness A according to German Industrial Standard (DIN) 53 505.

The dyed bobbin is then mounted on a knitting loom or another textile machine as desired and the filament is withdrawn directly for being processed. Upon finishing the accomplished textile fabric is submitted to a heat treatment, whereupon the crimp apparently reduced during the dyeing process develops fully again.

The crimp is determined by the measuring standard of the value of the initial crimp $K_1$. The determination takes place by the following method: The crimped filament is loaded with 1 mg/dtex, after a loading time of 5 minutes its length $l_0$ is measured. Subsequently, the same pre-load is applied to the filament which is hated to 180° C for 2 minutes in a shelf dryer. The filament is withdrawn from the shelf dryer and loaded with 100 mg/dtex for one minute. Under this pre-load the length $l_1$ is attained. The initial crimp value is then found by calculation $$K_1 = \frac{l_1 - l_0}{l_0}$$

The values of specific viscosity indicated in the examples have been determined as per the following method:

1 g of the polymer is dissolved in 100 ml of dichloracetic acid; subsequently the flow periods of solution and pure solvent are determined in known manner at 25° C by means of a capillary viscosimeter. The specific viscosity results from the equation.

$$\eta_{spec} = \frac{t_L - t_{LM}}{t_{LM}} = \frac{t_L}{T_{LM}} - 1,$$

wherein $t_L$ means the flow period of the polymer solution and $t_{LM}$ means the flow period of the solvent through the capillary viscosimeter.

The following examples illustrate the invention:

EXAMPLE 1

Polytetramethylene terephthalate with a specific viscosity of 1.38 was spun in side-by-side position to polyethylene terephthalate which had been modified with 0.6 % of triethoxy silane ethyl-phosphonic acid diethyl ester and which had a specific viscosity of 0.45. The output was 37 g/min. per component, the nozzle had 32 orifices. The spinning filament was withdrawn at the rate of 1 500 m/min. and subsequently stretched on a draw-twister, Zinser 16 S, 1 : 3.205 at a temperature of 90° C of the godet and at 130° C of the heating plate (flat iron). The latent crimp of the stretched filament was initiated by means of a device such as it is described by British Patent No. 1,198,035, and the crimped filament was wound on a bobbin the tube of which had holes drilled through. The bobbin weighed 1.5 kg; the type "Alucolor DSB 1000" was used as winding device. The cross angle was 17°, the Shore hardness of the winding was 40°. The $K_1$ — value of the off-white filament was determined at (30.2 ± 1.1) %; the error as specified corresponds to the 95 % reliability range.

The off-white bobbin was then dyed first green at 125° C, then once more yellow at 125° C; this double dyeing process inflicts especially hard conditions on the crimp of the filament.

The $K_1$-value of the blue filament was (30.3 ± 2.3) %, that means the crimp underwent the dyeing process without any crimp loss. The Shore hardness was measured by means of a Zwick-densimeter.

EXAMPLE 2

A spinning test as per example 1 was carried out which yielded, however, an output of polytetramethylene terephthalate of 27.6 g/min and of the modified polyethylene terephthalate of 55.2 g/min. The spinning filament was stretched as per example 1, crimped and wound on a bobbin.

The dyeing was as well carried out according to example 1. The off-white yarn had a $K_1$-value of (26.4 ± 1.7) %, the dyed yarn had a $K_1$-value of (25.6 ± 1.7) %.

EXAMPLE 3

Through a 32-holes nozzle polytetramethylene terephthalate of the specific viscosity of 1.35 was spun in side-by-side position against polyethylene terephthalate which had been modified by 1 % of trimellic acid anhydride and which had a specific viscosity of 0.52. The output was for each component 23 g/min. The spun take-off was 1 500 m/min.

The spun filament was stretched at 1 : 2.77 at the same temperature of the godet and of the heating plate as specified in example 1. The initiation of the crimp and the winding of the crimped filament was carried out according to example 1.

The filament was dyed at 125° C.

The $K_1$-value prior to the dyeing process was (26.2 ± 0.6)%, after dyeing (25.4 ± 3.3) %. It is obvious that the crimp had not been affected adversely.

EXAMPLE 4

Polyethylene terephthalate of the specific viscosity of 0.45 which had been modified by means of 0.6 % of triethoxy silane ethyl - phosphonic acid diethyl ester was spun in side-by-side position against polyethylene terephthalate of the specific viscosity of 0.91 at an output of 36 g/min each. The spun take-off was 1 500 m/min.; the filament was stretched at the ratio of 1 : 3.0 over a godet at 90° C and a heating plate at 160° C; subsequently, according to example 1, crimped and wound on a bobbin. The bobbin was dyed at 100° C while adding a carrier. The $K_1$-value prior to the dyeing process was (23.9 ± 0.6) %, after the dyeing process (22.0 ± 0.6) %. The crimp was not affected adversely either by the dyeing process and no noticeable loss occurred.

EXAMPLE 5

Polytrimethylene terephthalate of the specific viscosity of 1.41 was spun in side-by-side position against polyethylene terephthalate which had been modified by means of 0.6% of triethoxy silane ethyl-phosphonic acid diethyl ester and which had a specific viscosity of 0.45, at a spun take-off of 1 500 m/min. and an output of 37 g/min. each. The spun filament was stretched, crimped and wound on a bobbin according to example 1.

The bobbin was dyed at 125° C. The $K_1$-value was prior to the dyeing process (14.9 ± 1.4) %, after the dyeing process (16.6 ± 0.6) %; the crimp was not impeded by the dyeing process.

EXAMPLE 6

A false-twist textured filament of polyethylene terephthalate was wound on a tube equipped with drilled-in orifices according to examples 1 – 5 with a Shore hardness of 40°. The bobbin was dyed at 100° C while adding a carrier. The $K_1$-value — measured at a temperature of 160° C in the shelf dryer — prior to the dyeing process was (12.1 ± 0.3) %, after the dyeing process (6.2 ± 0.6) %. After having dyed a second filament at 125° C the $K_1$-value was (4.1 ± 0.9) %.

The crimp of these filaments had been seriously affected by the dyeing process.

EXAMPLE 7

A filament was prepared according to example 1, but it was wound on a bobbin with a Shore hardness of 20°. The dyeing process led to the same characteristics as those described in example 1.

After having wound-up with a Shore hardness of 10° the filament otherwise prepared according to example 1, it was not possible anymore to withdraw the filament trouble-free directly from the bobbin to be processed into a textile fabric, due to the unsatisfactory build-up of the bobbin.

A filament also prepared according to example 1, but wound on the bobbin with a Shore hardness of 60° showed the same crimp values as the filament according to example 1; it could be withdrawn and processed further smoothly and its dyeing characteristics were satisfactory. A higher Shore hardness of 80° resulted in an irregular penetration of the bobbin during the dyeing process.

What is claimed is:

1. A process for making crimped, dyed multicomponent filaments, consisting of at least two polyester components, which comprises combined spinning of said polyester components in side-by-side relationship or in eccentric sheath-core relationship, stretching and heating the spun filaments to develop the crimp, winding the spun crimped filaments at a Shore hardness of from 15° to 70° on a bobbin having a tube containing orifices, and dyeing the spun crimped filaments while wound on said bobbin without significant loss of crimp, wherein said dyed filaments are capable of further processing into textile fabric without rewinding.

2. The process according to claim 1 wherein polyethylene terephthalate is used as one polyester component and polyethylene terephthalate modified with triethoxy silane ethylphosphonic acid diethyl ester is used as the other component.

3. The process of claim 1 wherein polyethylene terephthalate is used as one polyester component and polyethylene terephthalate modified with trimellitic acid is used as the other component.

4. The process of claim 1 wherein polyethylene terephthalate is used as one polyester component and polyethylene terephthalate modified with pentaerythrite is used as the other component.

5. Process according to claim 1 which comprises that the filament, after the development of the crimp, is wound on a bobbin with a Shore hardness of from 30° to 50°.

6. Process according to claim 1 which comprises that polytetramethylene terephthalate is used as one polyester component and that polyethylene terephthalate modified with triethoxy silane ethyl-phosphonic acid diethyl ester is used as the other component.

* * * * *